United States Patent [19]

van der Waal et al.

[11] 4,339,516

[45] Jul. 13, 1982

[54] METHOD OF MANUFACTURING REPRODUCTION MASKS FOR PRODUCING A PATTERN OF ELONGATE APERTURES IN A SHADOW MASK OF A COLOR CATHODE RAY TUBE

[75] Inventors: Jan van der Waal; Gerard Vermeulen, both of Eindhoven, Netherlands

[73] Assignee: U.S. Philips Corporation, New York, N.Y.

[21] Appl. No.: 872,170

[22] Filed: Jan. 25, 1978

Related U.S. Application Data

[63] Continuation of Ser. No. 691,468, Jun. 1, 1976, abandoned, which is a continuation of Ser. No. 557,273, Mar. 11, 1975, abandoned.

[30] Foreign Application Priority Data

Mar. 28, 1974 [NL] Netherlands ..... 7404209

[51] Int. Cl.[3] ..... G03C 5/00

[52] U.S. Cl. ..... 430/24; 313/403

[58] Field of Search ..... 430/24; 313/403

[56] References Cited

U.S. PATENT DOCUMENTS

| | | | |
|---|---|---|---|
| 2,292,313 | 8/1942 | Yule . | |
| 2,750,524 | 6/1956 | Braham . | |
| 3,666,462 | 5/1972 | Kaplan . | |
| 3,708,336 | 1/1973 | Nishizawa et al. . | |
| 3,973,965 | 8/1976 | Suzuki et al. | 313/403 X |
| 3,993,487 | 11/1976 | Hosokoshi et al. | 430/24 |

FOREIGN PATENT DOCUMENTS

| | | |
|---|---|---|
| 47-5668 | 2/1972 | Japan . |
| 1336108 | 11/1973 | United Kingdom . |

*Primary Examiner*—Roland E. Martin, Jr.

*Attorney, Agent, or Firm*—Algy Tamoshunas; Robert J. Kraus; Joseph P. Abate

[57] ABSTRACT

A method of manufacturing a pair of associated reproduction masks for manufacturing shadow masks for display tubes. In order to obtain elongate apertures which are enlarged in width on the side of the mask facing the screen, the second reproduction mask is formed by reproducing the first reproduction mask on a photographic plate by means of light rays which have a substantially greater divergence in a plane perpendicular to the long dimension of the apertures than in the plane parallel thereto.

6 Claims, 9 Drawing Figures

Figure 1:
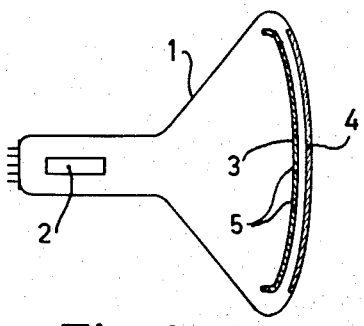

METHOD OF MANUFACTURING REPRODUCTION MASKS FOR PRODUCING A PATTERN OF ELONGATE APERTURES IN A SHADOW MASK OF A COLOR CATHODE RAY TUBE

This is a continuation of application Ser. No. 691,468, filed June 1, 1976, now abandoned, which is in turn a continuation of application Ser. No. 557,273, filed Mar. 11, 1975, now abandoned.

The invention relates to a method of manufacturing a pair of associated reproduction masks which are used in the manufacture of a pattern of apertures in a shadow mask of a cathode ray tube for displaying color pictures, which apertures are wider on one side of the shadow mask than on the other side. In this method a photographic plate is arranged parallel to and at some distance from a first of the reproduction masks and is then exposed to light.

It is to be noted that a reproduction mask is to be understood to include a positive or a negative image of a reproduction mask. A positive image is to be understood to mean an opaque plate on which the apertures of the shadow mask are reproduced as transparent areas, and a negative image is to be understood to mean a transparent plate on which the apertures of the shadow mask are reproduced as opaque areas. The reproduction masks may be either the so-called working masks which are used directly in the manufacture of the shadow mask or reproduction masks which serve to manufacture other reproduction masks, such as the so-called master masks.

A method of the kind described in the preamble is known from the British Patent Specification No. 1,336,108. The starting material in the manufacture of shadow masks is a thin metal sheet, generally of iron. The sheet is covered on both sides with a layer of a photosensitive lacquer. The reproduction masks are placed on the lacquer layers and the lacquer is exposed to light through the transparent areas in the reproduction masks. After exposure, the lacquer is removed from the areas when the apertures are to be provided in the shadow mask. The sheet is then exposed to an etchant which dissolves the metal in the areas which are no longer protected by lacquer, so that cavities are formed on both sides of the sheet. When etching is continued, the cavities on the sides of the plate unite so that a pattern of apertures is formed. It is important that the centers of the cavities throughout the sheet are either situated exactly opposite to each other on both sides of the mask or are shifted relative to each other in an accurately known manner. Since, moreover, the apertures in the shadow mask on the side of the display screen should be wider than on the other side, the two reproduction masks used are not identical. According to the British Patent Specification No. 1,336,108, the required accurate mutual dependence of the two reproduction masks is obtained by using a first reproduction mask of the pair as the starting material to manufacture the second. The first reproduction mask is arranged at an accurately determined distance parallel to a photographic plate and then the photographic plate is exposed to light which falls through the transparent parts of the first reproduction masks. The light originates from a homogeneous flat light source arranged at some distance parallel to the reproduction mask, the dimensions of which exceed those of the reproduction mask.

However, such a method is not suitable to manufacture a pair of associated reproduction masks which are used in the manufacture of a pattern of elongate (instead of circular) apertures in a shadow mask. In such a shadow mask the apertures are arranged in substantially parallel rows having only a narrow bridge between adjacent apertures in one row. The bridges are responsible for the tensile strength of the shadow mask at right angles to the rows and the thickness of the shadow mask at the area of the bridges must thus preferably not be influenced. However, in the direction of the rows the bridges should be as narrow as possible so as to intercept as few electrons as possible. These two conditions together require elongate apertures which widen only in cross-sections at right angles to their longitudinal direction. Known methods are not suitable for the manufacture of such apertures.

The invention mitigates these drawbacks of the prior art methods. In the method of the invention, the starting material is also a first reproduction mask which is used to manufacture the second and a photographic plate is arranged parallel to and at a short distance from the first reproduction mask. In the method according to the invention, however, the photographic plate 13 exposed to light rays which are substantially parallel to a plane which is substantially at right angles to the first reproduction mask.

Experiments have demonstrated that by exposing the photographic plate in this manner the positive images of the elongate apertures in the first reproduction mask formed on the photographic plate are magnified only in the aforesaid plane. This plane should therefore extend at right angles to the longitudinal direction of the elongate apertures so as to obtain in this manner a widened image of the elongate apertures. In the case of negative images of the elongate apertures in the first reproduction mask, the images formed on the photographic plate are reduced only in the plane. The plane should therefore extend parallel to the longitudinal direction of the elongate apertures so as to obtain in this manner a reduced image of the elongate apertures. In connection with the etching process used, this latter proves to be desirable to obtain the correct shape of the apertures in the shadow mask.

The light rays which are substantially parallel to a plane are obtained by means of a light source which is disposed in a sheath having an elongate rectangular cross-section with one open end directed towards the first reproduction mask. The sheath is wider than the pattern of apertures and is moved along the first reproduction mask at right angles to the longitudinal direction of the rectangular cross-section, i.e. parallel to the long dimension of the elongated apertures.

In order to obtain images on the photographic plate which are wider in one direction than the apertures in the first reproduction mask, the light source is preferably effectively flat and has a uniform brightness distribution substantially throughout the width of the cross-section of the sheath. Such a light source may be a uniformly illuminated frosted glass pane or a TL tube. According to the invention, such a light source may also be obtained by moving a comparatively small light source up and down over the width of the sheath.

According to another aspect of the invention, a displacement of the images on the photographic plate increasing in only one direction linearly with the distance to the center with respect to that on the first reproduction mask can be obtained by arranging a substantially punctiform light source in the center of a rectangular cross-section of the sheath.

Figure 2:
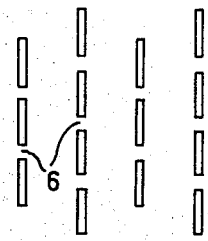
Figure 3:
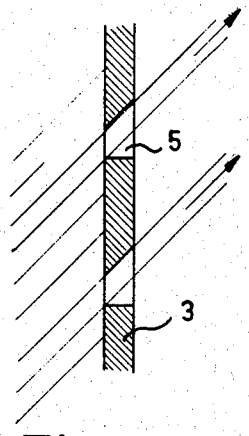
Figure 4:
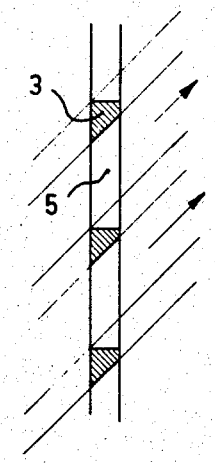
Figure 5:
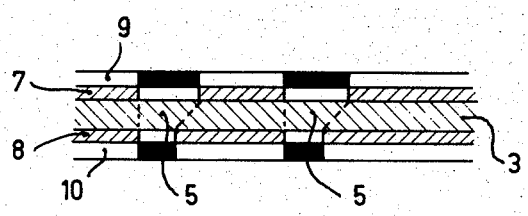
Figure 7:
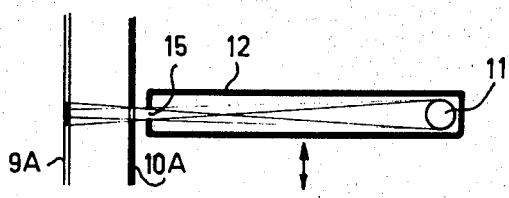
Figure 6:
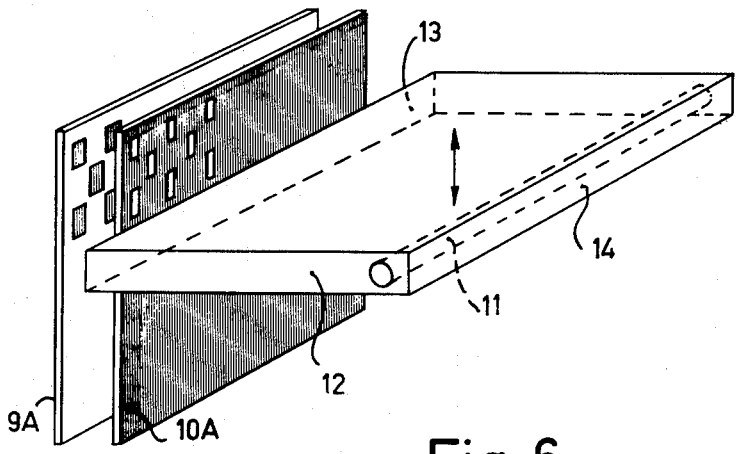
Figure 8:
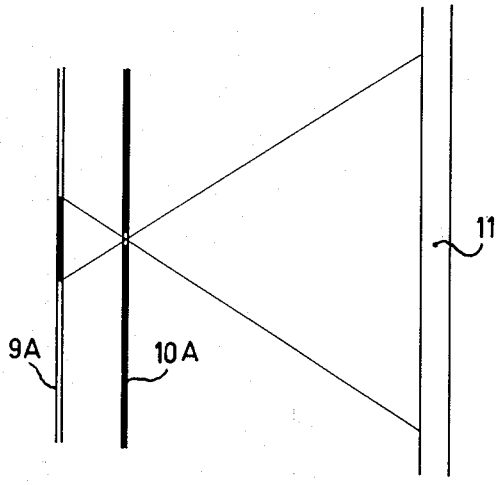
Figure 9:
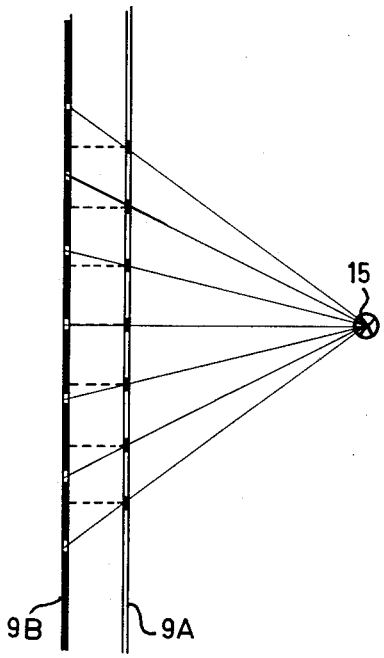

The invention will be described in greater detail with reference to the accompanying drawings, in which:

FIG. 1 shows a cathode-ray tube for displaying color pictures,

FIG. 2 shows a part of the pattern of apertures in the shadow mask of said tube, FIGS. 3 and 4 are two cross-sectional views of a shadow mask in two orthogonal planes, FIG. 5 is a cross-sectional view of the shadow mask during the manufacture, FIG. 6 is an exposure arrangement for the manufacture of reproduction masks, and FIGS. 7, 8 and 9 show diagrammatically the light rays in the arrangement shown in FIG. 5.

The cathode-ray tube shown in FIG. 1 is the known shadow mask display tube having an evacuated envelope 1, means 2 to generate three electron beams, a shadow mask 3 and a display screen 4. The shadow mask is a thin iron sheet of approximately 0.15 mm thickness which has a large number of apertures 5. The pattern of the apertures 5 is shown in FIG. 2. The apertures are arranged in vertical rows having narrow bridges 6 between two adjacent apertures in the same row. A red, a green and a blue phosphor strip on the display screen 4 are associated with each row of apertures. The bridges 6 should be as narrow as possible so as to intercept as few electrons as possible. Since the bridges 6 determine the tensile strength of the shadow mask in a direction at right angles to the rows, the thickness of the shadow mask (0.15 mm) at the area of the bridges should be influenced as little as possible.

FIG. 3 is a cross-sectional view of a portion of the shadow mask at right angles to the vertical rows of apertures and FIG. 4 is a cross-sectional view along a vertical row of apertures. It is obvious from these figures that the apertures 5 widen in the direction of the display screen 4. This is necessary to prevent the electron beams from colliding with the inner wall of the apertures 5 where they might liberate secondary electrons which would detrimentally influence the color display by their indefinite direction.

The manufacture of the shadow mask 3 will be described with reference to FIG. 5. In this embodiment the shadow mask 3 has two photosensitive layers 7 and 8 which become insoluble in a developing liquid by exposure to light and are then resistent against an etchant which is capable of etching apertures in the shadow mask 3. Reproduction masks 9 and 10, which are opaque in the areas where the apertures 5 are to be etched, are placed on the photosensitive layers 7 and 8, respectively. After exposure on both sides through the reproduction masks 9 and 10 (negative images) and after development with the developing liquid, a pattern of apertures are formed on the layers 7 and 8 through which the etchant can reach the shadow mask 3 and etch the apertures 5, which are shown in broken lines.

It is obvious from FIG. 5 that the reproduction masks 9 and 10 are not identical. The opaque areas in the reproduction mask 9 are slightly larger than those in the reproduction mask 10 and moreover the centres are not directly opposite to each other.

However, it is also obvious from FIGS. 3 and 4 that the enlargement in planes at right angles to the rows of apertures is much larger than in planes through the rows. This is in strong contrast with the situation in shadow masks having circular apertures. The method already known from the above-mentioned British Patent Specification No. 1,336,108 to manufacture the reproduction mask 9 by means of the reproduction mask 10 can thus not be used.

FIG. 6 shows an exposure arrangement which may be used to manufacture the reproduction mask 9 for a shadow mask having elongate apertures by means of the reproduction mask 10. A positive image 10A of the reproduction mask 10 is arranged parallel to and at some distance from a photographic plate 9A which, after exposure and development, will be used to manufacture the reproduction mask 9. The photographic plate 9A is exposed through the reproduction mask 10A by a light source 11 which is longer than the width of the reproduction mask 10A. The light source 11 is in a sheath 12 of opaque material, the open side 13 of which has a gap 15, 0.5 mm high and, faces the reproduction mask 10A. The sheath 12 is moved up and down parallel to the longitudinal direction of the transparent regions in the mask 10A (see arrows).

FIG. 7 shows the exposure of the reproduction mask 10A in a given vertical plane at right angles to the photographic plate 9A and FIG. 8 shows the exposure of the reproduction mask 10A in a given horizontal plane at right angles to the photographic plate 9A. It is immediately obvious from FIGS. 7 and 8 that the divergence of the light rays in the plane perpendicular to the long dimension of the apertures (FIG. 8) is substantially greater than in the plane parallel to the long dimension (FIG. 7). Hence, the magnification of the image in a vertical direction, i.e. in the longitudinal direction of the elongate apertures (FIG. 7), is very small, while the magnification of the image in a horizontal direction, i.e. at right angles to the longitudinal direction of the elongate apertures (FIG. 8), is considerable. It is also obvious from FIG. 8 that the magnification in a horizontal direction can be varied by varying the distance between the photographic plate 9A and the reproduction mask 10A. The light source 11 may be a TL-tube or a uniformly exposed frosted glass pane. An elongate light source may also be formed by means of a light source of comparatively small dimensions which is moved up and down over the width of the sheath 12. Of course, this movement should be considerably more rapid than the up and down movement of the sheath 12 itself.

FIG. 9 finally shows how the movement of the centres of the images of the apertures in the reproduction mask 10 is effected with respect to reproduction mask 9. If this movement need be present only in a horizontal direction and increasing from the centre towards the edge of the shadow mask, a punctiform light source 15 is mounted in the exposure arrangement shown in FIG. 6, for example, at 14. Up and down movement of the sheath 12 then provides an exposure which is shown in FIG. 9 for a given horizontal plane. No movement occurs in the vertical plane. In this manner, a positive image 9B is produced by means of the negative reproduction mask 9A. Reversal of the mask 9B ultimately provides the required negative reproduction mask 9.

Of course it is not necessary that first a magnified image is manufactured and then the movement is effected. This sequence may be varied, while all kinds of intermediate operations may be carried out.

What is claimed is:

1. A method of manufacturing a reproduction mask used in the manufacture of a pattern of elongated apertures in a shadow mask of a color cathode ray tube, said apertures being wider on one side of said shadow mask than on the other side thereof, said method comprising the steps of: arranging a first reproduction mask having a pattern of transparent and opaque areas corresponding to the pattern of said apertures on said other side of said shadow mask and a photographic plate generally parallel to each other and spaced a predetermined distance apart; exposing said photographic plate through said first reproduction mask to light rays having substantially greater divergence in a first plane perpendicular to the long dimension of areas on said first reproduction mask corresponding to said apertures than in a second plane parallel to said long dimension to project on said photographic plate images of said areas which are magnified more in a direction perpendicular to said long dimension than in a direction parallel thereto; and developing the exposed photographic plate to form a second reproduction mask.

2. A method according to claim 1, wherein said step of exposing includes illuminating said first reproduction mask by an elongated light source extending in a plane parallel to and being spaced from said first reproduction mask, said elongated light source having a length greater than the width of said pattern on said first reproduction mask and being oriented with the longitudinal axis thereof perpendicular to said long dimension; and moving said elongated light source in a direction parallel to said long dimension.

3. A method according to claim 2, wherein said elongated light source is substantially rectangular and has a substantially uniform brightness distribution.

4. A method according to claim 1, wherein said step of exposing includes illuminating said first reproduction mask by a light source disposed in a sheath having a rectangular aperture facing said first reproduction mask with the longitudinal axis of said rectangular aperture being perpendicular to said long dimension, said rectangular aperture having a length greater than the width of said pattern on said first reproduction mask; and moving said sheath relative to said first reproduction mask in a direction parallel to said long dimension.

5. A method according to claim 4, wherein said light source is relatively small and is moved back and forth in said sheath perpendicularly to said longitudinal axis of said rectangular aperture.

6. A method according to claim 4, wherein said light source is punctiform and is stationary with respect to said sheath.

* * * * *